US008824949B2

(12) United States Patent
Shirai et al.

(10) Patent No.: US 8,824,949 B2
(45) Date of Patent: Sep. 2, 2014

(54) IMAGE FORMING METHOD

(71) Applicants: Aya Shirai, Tokyo (JP); Asao Matsushima, Tokyo (JP); Yoshiyasu Matsumoto, Tokyo (JP); Ryuichi Hiramoto, Tokyo (JP); Taiki Amemiya, Tokyo (JP); Tatsuya Nagase, Tokyo (JP)

(72) Inventors: Aya Shirai, Tokyo (JP); Asao Matsushima, Tokyo (JP); Yoshiyasu Matsumoto, Tokyo (JP); Ryuichi Hiramoto, Tokyo (JP); Taiki Amemiya, Tokyo (JP); Tatsuya Nagase, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 49 days.

(21) Appl. No.: 13/756,613

(22) Filed: Feb. 1, 2013

(65) Prior Publication Data

US 2013/0202337 A1 Aug. 8, 2013

(30) Foreign Application Priority Data

Feb. 6, 2012 (JP) ..... 2012-023437

(51) Int. Cl.
*G03G 15/20* (2006.01)
*G03G 8/00* (2006.01)
*G03G 9/087* (2006.01)

(52) U.S. Cl.
CPC ..... *G03G 8/00* (2013.01); *G03G 9/08797* (2013.01)
USPC ..... 399/341; 399/342

(58) Field of Classification Search
USPC ..... 399/341–342
See application file for complete search history.

(56) References Cited

U.S. PATENT DOCUMENTS

| | | | | |
|---|---|---|---|---|
| 7,995,959 | B2 * | 8/2011 | Nakamura et al. | 399/341 |
| 2007/0059472 | A1 * | 3/2007 | Kitchin | 428/40.1 |
| 2009/0245903 | A1 * | 10/2009 | Nakamura et al. | 399/341 |
| 2012/0156604 | A1 * | 6/2012 | Fukatsu et al. | 430/105 |

FOREIGN PATENT DOCUMENTS

| | | |
|---|---|---|
| JP | 2002-341619 | 11/2002 |
| JP | 2009-014823 | 1/2009 |
| JP | 2010-039238 | 2/2010 |

* cited by examiner

*Primary Examiner* — G. M. Hyder
(74) *Attorney, Agent, or Firm* — Lucas & Mercanti, LLP

(57) ABSTRACT

An image forming method includes: performing a first gloss processing and a second gloss processing. The first gloss processing includes: heating and pressing a processed body which supports a first toner layer containing at least a clear toner [X] onto a first surface of a recording material, while allowing the first toner layer to be closely adhered to a gloss processing belt; and cooling the same. The second gloss processing includes heating and pressing a processed body which supports a second toner layer containing at least a clear toner [Y] onto a second surface of the recording material, while allowing the second toner layer to be closely adhered to the gloss processing belt; and cooling the same. Here, a storage elastic modulus G' X (150) at 150° C. of the clear toner [X] is lower than a storage elastic modulus G'Y (150) at 150° C. of the clear toner [Y].

4 Claims, 5 Drawing Sheets

FIG.5

| | PRINTED MATTER No. | TONER TYPE | | PHYSICAL PROPERTIES | | | EVALUATION ITEMS | | | |
|---|---|---|---|---|---|---|---|---|---|---|
| | | | | STORAGE ELASTIC MODULUS G'(150) | | | GLOSS LEVEL | | | BLOCKING |
| | | FIRST SURFACE (FRONT SIDE) | SECOND SURFACE (BACK SIDE) | FIRST SURFACE G'X(150) dyn/cm² | SECOND SURFACE G'Y(150) dyn/cm² | ⊿[G'X(150) -G'Y(150)] dyn/cm² | FIRST SURFACE K[X] | SECOND SURFACE K[Y] | ⊿[K[Y] -K[X]] | |
| EXAMPLE 1 | [P1] | CLEAR TONER [X-1] | CLEAR TONER [Y-1] | $2 \times 10^3$ | $1 \times 10^4$ | $8 \times 10^3$ | 75 | 82 | 7 | ◎ |
| EXAMPLE 2 | [P2] | CLEAR TONER [X-1] | CLEAR TONER [Y-2] | $2 \times 10^3$ | $9 \times 10^4$ | $8.8 \times 10^4$ | 74 | 75 | 1 | ◎ |
| EXAMPLE 3 | [P3] | CLEAR TONER [X-1] | CLEAR TONER [Y-3] | $2 \times 10^3$ | $6 \times 10^3$ | $4 \times 10^3$ | 74 | 81 | 7 | ○ |
| EXAMPLE 4 | [P4] | CLEAR TONER [X-2] | CLEAR TONER [Y-1] | $4 \times 10^2$ | $1 \times 10^4$ | $1.96 \times 10^4$ | 81 | 83 | 2 | ◎ |
| EXAMPLE 5 | [P5] | CLEAR TONER [X-3] | CLEAR TONER [Y-1] | $7 \times 10^3$ | $1 \times 10^4$ | $3 \times 10^3$ | 70 | 83 | 13 | ○ |
| COMPARATIVE EXAMPLE 1 | [P6] | CLEAR TONER [X-1] | CLEAR TONER [X-1] | $2 \times 10^3$ | $2 \times 10^3$ | 0 | 65 | 80 | 15 | × |
| COMPARATIVE EXAMPLE 2 | [P7] | CLEAR TONER [Y-1] | CLEAR TONER [Y-1] | $1 \times 10^4$ | $1 \times 10^4$ | 0 | 33 | 79 | 46 | ○ |
| COMPARATIVE EXAMPLE 3 | [P8] | CLEAR TONER [Y-1] | CLEAR TONER [X-1] | $1 \times 10^4$ | $2 \times 10^3$ | $-8 \times 10^3$ | 34 | 75 | 41 | ○ |

IMAGE FORMING METHOD

CROSS-REFERENCE TO RELATED APPLICATION

The present U.S. patent application claims a priority under the Paris Convention of Japanese patent application No. 2012-023437 filed on Feb. 6, 2012, which shall be a basis of correction of an incorrect translation, and is incorporated by reference herein.

BACKGROUND OF THE INVENTION

1. Field of the Invention

The present invention relates to an image forming method.

2. Description of the Related Art

Printed images represented by photographic images, posters, and so on, have recently been able to be fabricated by an ink jet device, and an image forming apparatus using an electro-photographic method due to development of digital processing technologies, in addition to a conventional silver halide photographic process, and a printing method such as gravure printing. Some printed matters such as photographic images and posters fabricated by such an image forming apparatus require typography in which a gloss surface is uniformly formed on the entire surface of a recording material.

From this background, techniques have been studied for forming a uniform gloss surface in the electro-photographic method. Specifically, an image forming apparatus has appeared which fabricates a printed matter in which a high gloss surface is uniformly formed by a device called a gloss imparting device. This device is connected to an electro-photographic printer or the like, and heats and presses a toner layer formed by the printer from a color toner and a clear toner, while the toner layer is in contact with a belt member. Then, the surface of the toner layer is cooled while being in contact with the belt member so as to solidify the toner layer, and finally, the printed matter is peeled off from the belt member. Thus, an image having a uniform high gloss surface is provided (for example, see Japanese Patent Application Laid-open Publication No. 2002-341619). This is called a cooling-and-peeling method, in which a heated toner layer is cooled while being closely adhered to a belt member, and then peeled off in a solidified state, thus transferring a shape of the belt member to the toner layer. Thus, a printed matter having a uniform high gloss surface is obtained.

There is also known a method in which such a high gloss image is formed on both sides. For example, Japanese Patent Application Laid-open Publication No. 2010-39238 discloses that a double-sided image is formed by performing gloss processing at a plurality of stages on both front and back sides of a recording material.

In a method described in Japanese Patent Application Laid-open Publication No. 2010-39238, similar gloss processing is used for both front and back sides. However, there has been a problem in that, when a uniform high gloss image is formed in this method on one side of an image recording medium such as paper, and another image is formed on the back side thereof using this method, a gloss level of the high gloss image which is formed first is decreased, and an image having a desired gloss level is not able to be obtained.

In order to solve this problem, a method has been proposed to have the same gloss level on both sides by changing fixing conditions for the front side and back side, as disclosed in, for example, Japanese Patent Application Laid-open Publication No. 2009-14823.

However, the gloss processing method disclosed in Japanese Patent Application Laid-open Publication No. 2009-14823 above, the same toner is used for the front side and the back side, and the fixing conditions are changed. Therefore, there has been a problem in that a device becomes complicated and it takes time to output images. Hence, improvement is required.

Meanwhile, when a clear toner which is appropriate for gloss processing, in other words, a clear toner which has a low elasticity and is thus easily deformed by heat, is used for a front side and a back side, thermal blocking tends to happen as gloss-processed images on both sides are stacked on each other.

SUMMARY OF THE INVENTION

The present invention has been accomplished in view of the above-mentioned problems and aspects. A solution for the problems is to provide an image forming method by which such an image is obtained that a difference in gloss level between both sides is easily reduced and thermal blocking is inhibited in gloss processing.

In order to solve the aforementioned problems, the present inventors have studied causes and so on of the problems. As a result, the present inventors have reached the present invention after discovering that, when different clear toners are used for a front side and a back side, and a toner for the front side has the lower elasticity on heating, elasticity of the front side is reduced by heat that is generated during gloss processing on a surface of the front side. Thus, elastic recovery is unlikely to happen even when heat is applied to the front side due to gloss processing on the back side. Therefore, an image is able to be obtained in which reduction in gloss level is small and there is no difference in gloss level between the front side and the back side.

Thus, the foregoing problems in respect of the present invention are solved by a method stated below.

To achieve at least one of the abovementioned objects, an image forming method, reflecting one aspect of the present invention, includes:

performing a first gloss processing including:

heating and pressing a processed body which supports a first toner layer containing at least a clear toner [X] onto a first surface of a recording material, while allowing the first toner layer to be closely adhered to a gloss processing belt; and cooling the heated and pressed processed body, whereby glossiness is added to a surface of the first toner layer, and performing a second gloss processing including heating and pressing a processed body which supports a second toner layer containing at least a clear toner [Y] onto a second surface of the recording material, while allowing the second toner layer to be closely adhered to the gloss processing belt; and cooling the heated and pressed processed body, whereby glossiness is added to a surface of the second toner layer, wherein a storage elastic modulus G' X (150) at 150° C. of the clear toner [X] used for the first toner layer is lower than a storage elastic modulus G' Y (150) at 150° C. of the clear toner [Y] used for the second toner layer.

Preferably, the clear toner [X] and the clear toner [Y] are in a relationship expressed by an equation below, where a difference between the storage elastic modulus G' X (150) at 150° C. of the clear toner [X] and the storage elastic modulus G' Y (150) at 150° C. of the clear toner [Y] is expressed as Δ [G' Y (150)−G' X (150)];

$$\Delta[G'Y(150)-G'X(150)]>5\times10^3\ \mathrm{dyn/cm^2}.$$

Preferably, the G' X (150) is within a range from $1\times10^2$ to $3\times10^4$ dyn/cm$^2$.

Preferably, G' Y (150) is within a range from $1\times10^3$ to $1\times10^5$ dyn/cm$^2$.

BRIEF DESCRIPTION OF THE DRAWINGS

The present invention will be more fully understood by the following detailed description and the accompanying drawings, However, these are not intended to limit the present invention, wherein:

FIG. 5 shows Table 1.

PREFERRED EMBODIMENTS OF THE PRESENT INVENTION

Figure 1A:
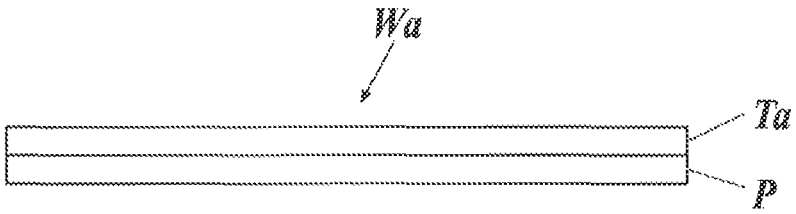
FIGS. 1A and 1B are schematic views for explaining a processed body used in an image forming method according to the present invention.

In an image forming method according to the present invention, gloss processing is carried out on a first surface of a recording material by heating, pressing, and then cooling a processed body, which supports a first toner layer containing at least a clear toner [X], while allowing the first toner layer to be closely adhered to a gloss processing belt, thus adding glossiness to a surface of the first toner layer. Thereafter, gloss processing is carried out on a second surface by heating, pressing, and cooling a processed body, which supports a second toner layer containing at least a clear toner [Y], while allowing the second toner layer to be closely adhered to the gloss processing belt, thus adding glossiness to a surface of the second toner layer. A feature of the image forming method according to the present invention is that a storage elastic modulus G' X (150) at 150° C. of the clear toner [X] used for the first toner layer is lower than a storage elastic modulus G' Y(150) at 150° C. of the clear toner [Y] used for the second toner layer. This is a technical feature common to the invention according to claims 1 and 2.

Although not definitely determined, an effect manifestation mechanism and a mechanism of action according to the present invention are speculated as follows.

In a case where a single type of clear toner is used to conduct gloss processing on a first surface (front side) and a second surface (back side) of a recording material under the same heating and pressing conditions, when the gloss processing is conducted first on the first surface, and then the gloss processing is conducted on the second surface after inverting the recording material, the first surface receives heat from a heating roller from the second surface side. Therefore, a toner which has been smoothed is melted again, and the clear toner tries to return to its original shape due to elastic recovery. Thus, the first surface is raised, resulting in reduction in gloss level of the first surface. In order to solve this problem, different clear toners are used for the first and second surfaces, and a clear toner having the lower elasticity on heating is used for the first surface. Therefore, the elasticity on the first surface side is reduced by heat during the gloss processing for the first surface, and elastic recovery is less likely to occur even when heat is applied to the first surface due to the gloss processing of the second surface. Hence, a reduction in gloss level of the first surface is curtailed, and images having a small difference in gloss level between the first surface and the second surface are obtained.

On the other hand, in a case where a clear toner, which has low elasticity, or is easily deformed by heat, is used for both of the first surface and the second surface, thermal blocking tends to happen because the gloss-processed images on both sides are stacked on each other. Therefore, a clear toner which is difficult to be deformed by heat is used for the second surface. As a result, thermal blocking is inhibited even when images on the first surface and the second surface are stacked on each other.

As a form for embodying the present invention, it is preferred that the clear toner [X] and the clear toner [X] are in a relationship expressed by an equation below, where a difference between the storage elastic modulus G' X (150) at 150° C. of the clear toner [X] and the storage elastic modulus G' Y (150) at 150° C. of the clear toner [Y] is expressed as Δ [G' Y (150)−G' X (150)].

$$\Delta[G'Y(150)-G'X(150)]>5\times10^3\ \text{dyn/cm}^2$$

Thus, a difference in gloss level between both sides is reduced, thus ensuring prevention of thermal blocking.

Detailed explanation will be provided below regarding the present invention and the constituents thereof as well as modes and forms for carrying out the present invention. The word "to" between numerical values will be used herein to mean that the numerical values stated before and after "to" are included as a lower limit value and a higher limit value, respectively.

[Image Forming Method]

Figure 1B:
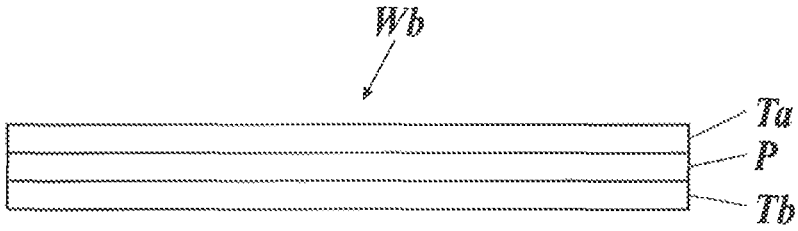

As illustrated in FIG. 1A, an image forming method according to the present invention is an image forming method for forming gloss images on both sides of a recording material P. In this method, a processed body Wa, which supports a first toner layer Ta containing a clear toner [X] on a first surface (front side) of the recording material P, is heated and pressured, and then cooled while being closely adhered to a gloss processing belt of a gloss processing device described later. Thus, gloss processing is performed for making the first toner layer Ta glossy. Thereafter, as illustrated in FIG. 1B, a processed body Wb, which supports a second toner layer Tb containing a clear toner [Y] on a second surface (back side) of the recording material P, is heated and pressured, and then cooled while being closely adhered to the gloss processing belt. Thus, gloss processing is performed for making the second toner layer Tb glossy.

<Storage Elastic Modulus G'>

A feature of the present invention is that a storage elastic modulus G' X (150) at 150° C. of the clear toner [X] used for the first toner layer is lower than a storage elastic modulus G' Y (150) at 150° C. of the clear toner [Y] used for the second toner layer.

Here, the storage elastic modulus G' is measured by using "MR-500 Soliquid Meter" (produced by Rheology Co., Ltd.) following the steps (1) to (5) below.

(1) A clear toner is put and flattened out in a petri dish for a measurement sample in an environment at a temperature 20+/−1° C., and a relative humidity of 50+/−5% RH, and left for at least 12 hours. Thereafter, 0.6 g of the clear toner is mounted on compression-molding equipment, and a load of 3 t is applied thereto for 30 seconds. Thus, a pellet having a diameter of 1 cm is made.

(2) The pellet is mounted on a parallel plate having a diameter of 0.977 cm.

(3) A temperature at a measurement point is set to −20° C. which is a softening point of the toner, and a parallel plate gap is set to 3 mm. With these settings, the measurement point is heated to the softening point of the toner −20° C., and the pellet is compressed until the gap becomes 3 mm, and thereafter cooled to 35° C.

(4) After the temperature at the measurement point is set to 35° C., the temperature at the measurement point is increased to 200° C. at a rate of temperature increase of 5° C. per minute while applying sine wave vibration at a frequency of 1.0 Hz, and a complex modulus G* is measured when the temperature is 150° C. An angle of strain is controlled by automatic strain control.

(5) A storage elastic modulus G' is calculated from the complex modulus G*.

Figure 2:
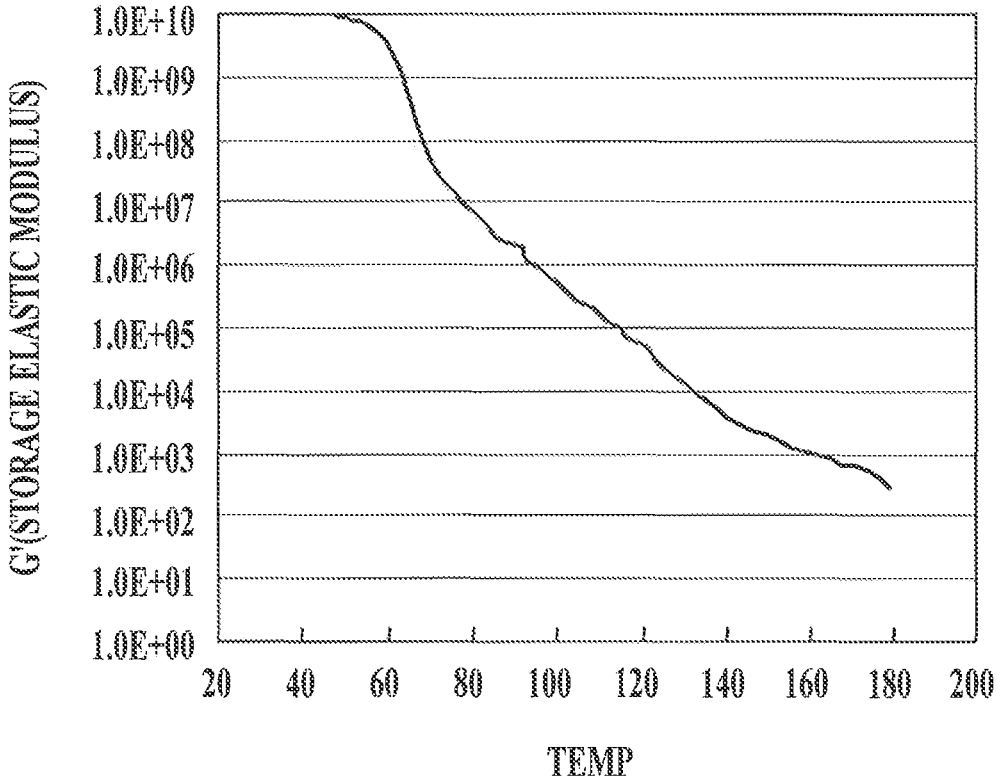
FIG. 2 is a view showing a typical example of a storage elastic modulus G'.

An example of the storage elastic modulus G' is shown in FIG. 2.

In the present invention, it is preferred that the clear toner [X] and the clear toner [Y] are in a relationship expressed by the equation below, where a difference between the storage elastic modulus G' X (150) at 150° C. of the clear toner [X] forming the first toner layer and the storage elastic modulus G' Y (150) at 150° C. of the clear toner [Y] forming the second toner is Δ [G' Y (150)−G' X (150)].

$$\Delta[G'Y(150)-G'X(150)]>5\times10^3\ \text{dyn/cm}^2$$

The reason why the equation Δ [G' Y (150)−G' X (150)]> $5\times10^3$ dyn/cm$^2$ is used is because thermal blocking is inhibited more effectively even when the first surface and the second surface are stacked on each other.

A preferred range of the G' X (150) is from $1\times10^2$ to $3\times10^4$ dyn/cm$^2$ ($1\times10^1$ to $3\times10^3$ N/m$^2$), and a range from $4\times10^2$ to $7\times10^3$ dyn/cm$^2$ is more preferred.

A preferred range of the G' Y (150) is from $1\times10^3$ to $1\times10^5$ dyn/cm$^2$ ($1\times10^2$ to $1\times10^4$ N/m$^2$), and a range from $6\times10^3$ to $9\times10^4$ dyn/cm$^2$ is more preferred.

In the image forming method according to the present invention, the first and second toner layers Ta and Tb of the processed bodies Wa and Wb that are used for gloss processing are layers which are formed by supplying at least the clear toners [X] and [Y] on the recording material P, respectively. To be specific, each of the toner layers Ta and Tb may be (1) a layer formed by an unfixed toner which is entirely in powder state, (2) a layer formed by a fixed toner which is entirely solidified, or (3) a laminated layer in which the layer formed of a powder-state unfixed toner is layered on the layer formed of a solidified fixed toner.

it is preferred that the layer (2), which is formed by an entirely solidified fixed toner, is a state of the toner layer Tb of the processed body Wb.

In the image forming method described below, the layer (2) formed by an entirely-solidified fixed toner is used for both of the first and second toner layers Ta and Tb.

To be more specific, the first and second toner layers Ta and Tb may be made of any of a toner layer of a single-color image formed by a chromatic toner, a toner layer of a multicolor image formed by superimposing chromatic toners, a toner layer formed only by a clear toner, and a toner layer formed by superimposing a chromatic toner and a clear toner. However, it is preferred that topmost layers of the first and second toner layers Ta and Tb, in other words, the layers to be in contact with a gloss processing belt that is a gloss processing belt 2 of an gloss processing device 1, are the layers made of clear toners.

It is preferred that the clear toners contained in the first and second toner layers Ta and Tb are provided, but not limited to, on the topmost layers of the first and second toner layers Ta and Tb.

Areas of the first and second toner layers Ta and Tb are not particularly limited. However, in a case where the first and second toner layers T1 and Tb, or the topmost layers thereof are made of layers formed by clear toners, it is preferred that the layers made of clear toners are formed on the entire surfaces of the recording material P. By forming the clear toner layers on the entire surfaces of the recording material P, respectively, a non-image area in which no image is formed by a chromatic toner, for example, is smoothed out so that the entire surfaces of the recording material P are smoothed out. In other words, the entire surfaces can be made glossy.

First, the image forming apparatus, in which the gloss processing device used for the image forming method of the present invention is embedded, will be explained.

[Image Forming Apparatus]

Figure 3:
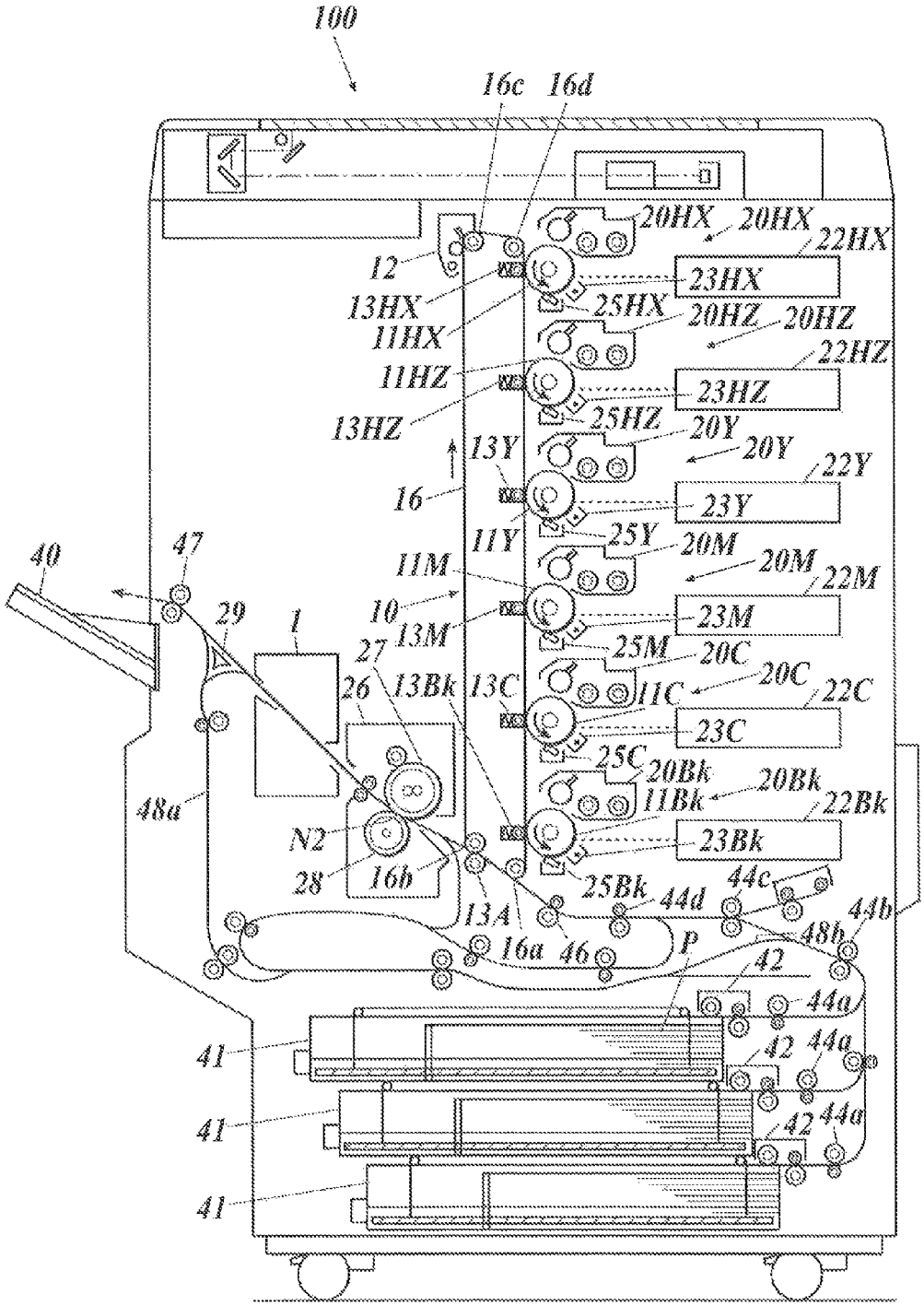
FIG. 3 is a sectional view showing an example of a configuration of an image forming apparatus in which a gloss processing device used for the image forming method according to the present invention is embedded.

FIG. 3 is a sectional view showing an example of a configuration of the image forming apparatus.

The image forming apparatus 100 is a tandem-type color image forming apparatus which is capable of continuously executing image forming processing and gloss processing on the first and second toner layers Ta and Tb.

The image forming apparatus 100 includes a clear toner image forming section 20HX for forming a clear toner image as the topmost layer of the first toner layer Ta which is subjected to gloss processing and comes into direct contact with the gloss processing belt 2 (see FIG. 4), a clear toner image forming section 20HY for forming a clear toner image as the topmost layer of the second toner layer Tb, chromatic toner image forming sections 20Y, 20M, 20C, and 20Bk for forming chromatic toner images in yellow, magenta, cyan, and black, respectively, an intermediate transfer section 10 which transfers the toner images formed by the clear toner image forming section 20H and the chromatic toner image forming sections 20Y, 20M, 20C, and 20Bk onto the recording material P, a fixing device 26 which executes fixing processing by pressurizing the recording material P while heating the same so that the toner images are fixed and the toner layers are obtained, and a gloss processing device 1 which smoothes out the surfaces of the toner layers.

A yellow toner image is formed in the chromatic toner image forming section 20Y, a magenta toner image is formed in the chromatic toner image forming section 20M, a cyan toner image is formed in the chromatic toner image forming section 20C, and a black toner image is formed in the chromatic toner image forming section 20Bk.

The clear toner image forming section 20HX includes a photoreceptor 11HX serving as an electrostatic latent image carrier, a charging unit 23HX which applies a uniform electrical potential to a surface of the photoreceptor 11HX, an exposure unit 22HX which forms an electrostatic latent image in a desired shape on the photoreceptor 11HX which is uniformly charged, an image development unit 21HX which conveys the clear toner [X] onto the photoreceptor 11HX and defines the electrostatic latent image, and a cleaning unit 25HX which recovers a residual toner remaining on the photoreceptor 11HX after primary transfer.

Similarly to the clear toner image forming section 20HX, the clear toner image forming section 20HZ includes a photoreceptor 11HZ, a charging unit 23HZ, an exposure unit 22HZ, an image development unit 21HZ, and a cleaning unit 25HZ.

The chromatic toner image forming sections 20Y, 20M, 20C, and 20Bk respectively includes photoreceptors 11Y, 11M, 11C, and 11Bk serving as static latent image carriers, charging units 23Y, 23M, 23C, and 23Bk which apply an uniform electrical potential to surfaces of the photoreceptors 11Y, 11M, 11C, and 11Bk, exposure units 22Y, 22M, 22C, and 22Bk which respectively form electrostatic images in desired shapes on the photoreceptors 11Y, 11M, 11C, and 11Bk that are uniformly charged, image development units 21Y, 21M, 21C, and 21Bk which convey chromatic toners onto the photoreceptors 11Y, 11M, 11C, and 11Bk, respectively, and define the electrostatic images, and cleaning units 25Y, 25M, 25C, and 25Bk which recover residual toners remaining on the photoreceptors 11Y, 11M, 11C, and 11Bk after primary transfer.

The intermediate transfer section 10 has an intermediate transfer body 16, primary transfer rollers 13H which transfer the clear toner images formed by the clear toner image forming sections 20HZ and 20HZ to the intermediate transfer body 16, primary transfer rollers 13Y, 13M, 13C, and 13Bk which transfer the chromatic toner images formed by the chromatic toner image forming sections 20Y, 20M, 20C, and 20Bk to the intermediate transfer body 16, a secondary transfer roller 13A by which the clear toner images transferred by the primary transfer rollers 13H to the intermediate transfer body 16, and the chromatic toner images transferred by the primary transfer rollers 13Y, 13M, 13C, and 13Bk to the intermediate transfer body 16, are transferred to the recording material P, and a cleaning unit 12 which recovers a residual toner remaining on the intermediate transfer body 16.

The intermediate transfer body is stretched by a plurality of supporting rollers 16*a* to 16*d*, and is an endless belt supported in a rotatable state.

In the fixing device 26, a pair of heating pressure rollers 27 and 28 is in pressure contact with each other, and a nip area N2 is formed in the pressure contact area of the heating pressure rollers 27 and 28.

[Gloss Processing Device]

The gloss processing device 1 is able to carry out a series of processes from heating and pressurizing, and then cooling of the processed bodies Wa and Wb in which the first and second toner layers Ta and Tb are formed on the recording material P, respectively, through pealing the processed bodies Wa and Wb from the gloss processing belt 2.

Figure 4:
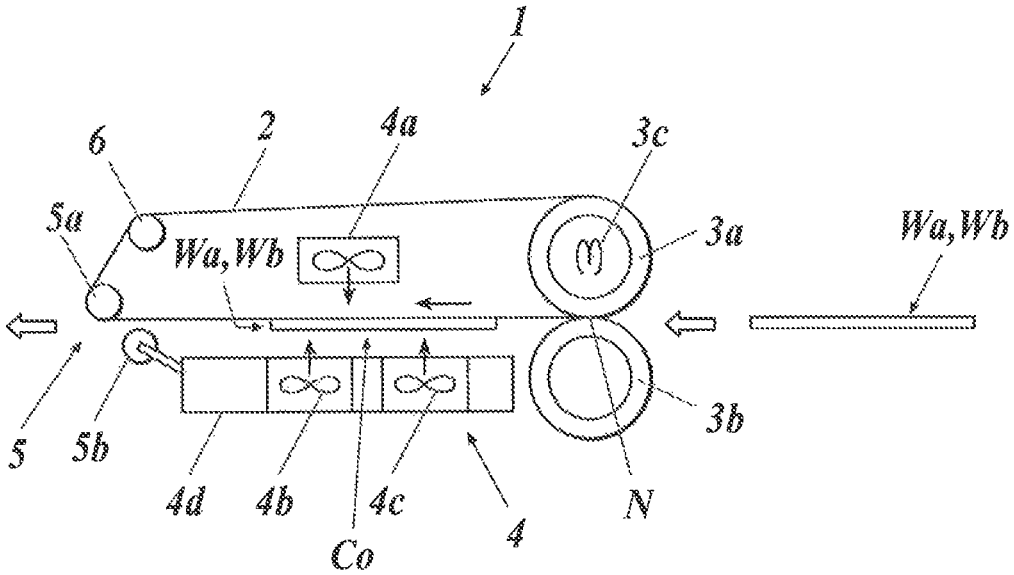
FIG. 4 is a sectional view showing an example of a configuration of the gloss processing device illustrated in FIG. 2.

Specifically, as illustrated in FIG. 4, the gloss processing device 1 includes a heating roller 3*a* driven at a constant speed, the endless gloss processing belt 2 which has a smooth surface and is stretched across the heating roller 3*a*, a peeling roller 5*a*, and a support roller 6 so that the smooth surface becomes an outer circumferential surface, a pressure roller 3*b* which presses the gloss processing belt 2 against the heating roller 3*a* and is arranged so as to form a nip area N with the gloss processing belt 2, a cooling mechanism 4 which is provided on a downstream side of the heating roller 3*a* and on an upstream side of the peeling roller 5*a* in a moving direction of the gloss processing belt 2, and a peeling mechanism 5 which is provided on the downstream side of the cooling mechanism 4 and in the vicinity of the peeling roller 5*a*.

One surface of the gloss processing belt 2 used in the image forming method according to the present invention is a smooth surface.

A preferred material of the gloss processing belt 2 is a material in which, for example, polyimide or polyethylene terephthalate (PET) is used as a base material thereof. The gloss processing belt 2 may be a seamless belt or made of a sheet-like film that is joined to form a belt shape.

It is preferred that a surface hardness of the gloss processing belt member, which is measured by nanoindentation on a release layer side (a side which comes into contact with a toner layer) thereof, ranges from 0.35 to 2 [GPa]. When the surface hardness measured by the nanoindentation method is 0.35 [GPa] or higher, high releasability is realized, and when the surface hardness is 2 [GPa] or lower, an ability to follow images is improved.

The surface hardness is measured by nanoindentation. An indenter having a distal end shape that is made of a diamond chip is pressed into a surface of a thin film or a material, and hardness of the release layer is obtained from a load P applied to the indenter and a projection area A under the indenter. This hardness of the release layer represents the surface hardness.

Further, in the present invention, it is preferred that a contact angle on the release layer side (the side that comes into contact with a toner image) ranges from 80 to 130[°], and a range of the contact angle from 90 and 110[°] is more preferred.

The contact angle in the present invention means a contact angle to pure water of the release layer of the belt member, The contact angle is obtained by measuring the contact angle to pure water in an environment of 20° C. and 50% RH by using a contact angle meter (CA-DT-A type produced by Kyowa Interface Science Co., LTD) The measurement is conducted at given 10 locations of the release layer of the belt member, and an average value thereof is used as the contact, angle in the present invention.

Preferably, the gloss processing belt member has a thickness ranging form 20 to 250 μm. With this range, good operability for conveyance and so on and good thermal conductivity are realized. It is preferred that a thickness of the release layer ranges from 0.1 to 50 μm, and a range from 0.5 to 10 μm is particularly preferred.

A preferred material used for the release layer includes fluorine resin and polysiloxane. In order to adjust the surface hardness, other chemical compound may be used together. Preferably, the material is copolymerized with, for example, acrylic compound.

Specifically, it is preferred that the material is a copolymer obtained by radical copolymerization of at least one of fluorine resin, polysiloxane, and a copolymer of fluorine resin and polysiloxane (hereinafter referred to as X), and an acrylic compound (hereinafter referred to as Y). A copolymer obtained by radical copolymerization of a copolymer of fluorine resin and polysiloxane, and an acrylic compound is particularly preferred. In the copolymerization of (X) and (Y), a ratio of (Y) is preferably from 5 to 95% by mass, and 5 to 50% by mass is more preferred.

The heating roller 3*a* and the pressure roller 3*b* are arranged so as to be in pressure contact with each other through the gloss processing belt 2. To be specific, one or both of the heating roller 3*a* and the pressure roller 3*b* have a silicon rubber layer or a fluorine-contained rubber layer on surfaces thereof respectively, and the nip area N is thus formed at the pressure contact area between the heating roller 3*a* and the pressure roller 3*b*. It is preferred that a width of the nip area N ranges from, for example, about 1 to 8 mm.

The heating roller 3*a* is made of a metallic base body of, for example, aluminum, and an elastic body layer that is made of, for example, silicon rubber, and coated on a surface of the base body. The heating roller 3*a* is formed to have a given outer diameter. Inside of the heating roller 3*a*, a halogen lamp within a range from 300 to 350 W, for example, is provided as a source of heat 3*c*, and the heating roller 3*a* is constructed to be heated so that a surface temperature thereof becomes a given temperature.

A pressure roller 3*a* may be made of a metallic base body of, for example, aluminum, and an elastic body layer that is made of, for example, silicon rubber, and coated on a surface of the base body. Further, the release layer made of, for example, a PFA (tetrafluoroethylene-perfluoroalkyl vinyl ether copolymer) tube may be covered on a surface of the elastic body layer, and the pressure roller 3*a* is formed to have a given outer diameter. The pressure roller 3*b* is constructed without a source of heat. In the pressure roller 3*b* may include a cooling device if desired.

The cooling mechanism 4 includes a cooling fan 4*a* and a cooling mechanism. The cooling fan 4*a* is present on an inner circumferential side of the gloss processing belt 2 and is arranged in a non-contact state with the gloss processing roller 2 in a region between the heating roller 3*a* and the peeling roller 5*a* on which the gloss processing belt 2 is stretched. Also, the cooling fan 4*a* supplies cooling air towards the above-mentioned region. The cooling mechanism is arranged on an outer circumferential side of the gloss processing belt 2 in a non-contact state with the gloss processing belt 2 in a region between the pressure roller 3*b* and a conveyance auxiliary roller 5*b*. The cooling mechanism includes two fans 4*b* and 4*c* which supply cooing air towards the above-mentioned region, and a heat sink 4*d* connected to each of the cooling fans 4*b* and 4*c*. With such a construction, in the cooling mechanism 4, a cooling region Co is formed in the region between the heating roller 3*a* and the peeling roller 5*a* on the outer circumferential side of the gloss processing belt 2.

The peeling mechanism 5 is constructed by a bent portion of the gloss processing belt 2, and the conveyance auxiliary roller 5*b*. The bent portion is formed as the peeling roller 5*a*, the heating roller 3*a*, and the support roller 6 are arranged in such positional relationships that an acute angle is formed about the peeling roller 5*a* that serves as a fulcrum. At the bent portion, a cyclic movement direction of the gloss processing belt 2 is significantly changed. The conveyance auxiliary roller 5*b* is provided so as to face the peeling roller 5*a*, and away from the peeling roller 5*a* by a distance that is equivalent or slightly larger than a thickness of the processed body Wa fabricated by forming the first toner layer Ta on the recording material P.

A roller diameter of the peeling roller 5*a* only needs to be a diameter in which a curvature thereof is controlled with respect to stiffness of the recording material P so that the processed body Wa is peeled off from the gloss processing belt 2 at the peeling mechanism 5. A preferred roller diameter of the peeling roller 5*a* is within a range from ϕ10 to 40 mm, for example.

<Image Forming Processing for the First Surface>

In the above-explained image forming apparatus 100, first, electrostatic latent images are formed as being respectively charged by the charging units 23HX, 23Y, 23M, and 23Bk on the photoreceptors 11HX, 11Y, 11M, 11C, and 11Bk, and respectively exposed by the exposure units 22HX, 22Y, 23M, 23C, and 23Bk in the clear toner image forming section 20HX and the chromatic toner image forming sections 20Y, 20M, 20C, and 20Bk, respectively. Then, the electrostatic images are developed by the image development units 21HX, 21Y, 21M, 21C, and 21Bk using toners, thus forming a clear toner image and chromatic toner images in respective colors. The clear toner image and the chromatic toner images in respective colors are transferred in series onto the intermediate transfer body 16 by the primary transfer rollers 13HX, 13Y, 13M, 13C, 13Bk, and then superimposed on the intermediate transfer roller 16, thereby forming toner powder layers of unfixed toners.

Meanwhile, the recording material P contained in a paper feed cassette 41 is fed by a paper feeding conveying unit 42, and conveyed by a plurality of paper feed rollers 44*a*, 44*b*, 44*c*, and 44*d*, and a registration roller 46. Then, at the secondary transfer roller 13A, the toner powder layers on the intermediate transfer body 16 are transferred onto the first surface of the recording material P. Thereafter, the toner powder layer transferred onto the first surface of the recording material P are fixed by heat and pressure applied thereto in the fixing device 26, thus forming the first toner layer Ta.

In the toner powder layers transferred on the first surface of the recording material P, a black toner image, a cyan toner image, a magenta toner image, a yellow toner image, and a clear toner image are stacked from the side of the recording material P in this order on the first surface of the recording material P. The first toner layer Ta obtained by fixing the toner powder layers in the fixing device 26 has a construction in which the topmost layer thereof is the clear toner layer.

It is preferred that a thickness of the clear toner layer in the first toner layer Ta is in a range from 2 to 50 μm, for example, <Fixing Processing Conditions for the First Surface>

Preferred conditions of fixing processing conducted by the fixing device 26 are a heating temperature ranging from 150 to 230° C., more preferably from 160 to 190° C., and nipping time ranging from 10 to 300 ms more preferably 20 to 70 ms.

The heating temperature in the fixing device 26 means a surface temperature of the heating pressure roller 27 with which the first toner layer Ta transferred onto the recording material P comes into contact.

The nipping time is calculated from a length in a conveying direction (mm)/linear velocity (mm/sec) of the nipping area N2×1000.

In the photoreceptors 11HX, 11Y, 11M, 11C, and 11Bk after the clear toner image or the chromatic toner image in each color is transferred to the intermediate transfer body 16, a toner remaining on the photoreceptor 11HX, 11Y, 11M, 11C, or 11Bk is removed by the cleaning unit 25HX, 25Y, 25M, 25C, or 25Bk, respectively. Thereafter, the photoreceptor 11HX, 11Y, 11M, 11C, or 11Bk is used for forming the next clear toner or chromatic toner image in each color.

In the intermediate transfer body 16 after the clear toner image or the chromatic toner image in each color is transferred to the recording material P by the secondary transfer roller 13A, a toner remaining on the intermediate transfer body 16 is removed by the cleaning unit 12. Thereafter, the intermediate transfer body 16 is used for forming the next clear toner or chromatic toner image in each color.

<Gloss Processing for the First Surface>

After the image forming processing for the first surface as set forth above, the gloss processing is carried out on the first toner layer Ta which is formed on the first surface of the recording material P.

Specifically, the processed body Wa is held and conveyed between the heating roller 3*a* and the pressure roller 3*b* in the nip area N in a state where the first toner layer Ta of the processed body Wa is in contact with the smooth surface of the gloss processing belt 2. In the nip area N, the first toner layer Ta is heated and melted, and, at the same time, pressured so that the first toner layer Ta is fused to have a uniform thickness following the smooth surface shape of the outer circumferential surface of the gloss processing belt 2 (a heating press process).

Because of the fusion, the processed body Wa is closely adhered to the outer circumferential surface of the gloss processing belt 2, and the processed body Wa is moved to the cooling region Co as the gloss processing belt 2 cyclically moves in a direction of arrow.

The processed body Wa is forcibly cooled by air that is supplied from the cooling fans 4*a* to 4*c* while passing through the cooling mechanism 4, and solidification of the first toner layer Ta is facilitated. Therefore, the surface of the first toner layer Ta is smoothed, thus forming a glossy toner image layer (a cooling process).

Then, the processed body Wa conveyed to the peeling mechanism 5 comes into contact with and is held by the conveyance auxiliary roller 5*b* on the back side (the second surface) thereof, and reaches the bent portion of the gloss processing belt 2 in this state. When the cyclic movement direction of the gloss processing belt 2 is greatly changed at the bent portion, the processed body Wa is peeled off from the gloss processing belt 2 due to stiffness (body) of the recording material P itself which constructs the processed body Wa. Then, as the center of gravity is moved to the conveyance auxiliary roller 5*b*, peeling of the processed body Wa off from the gloss processing belt 2 is facilitated, thus obtaining a single-sided printed matter having a glossy toner image layer on the first surface of the recording material P (a peeling process). The linear velocity of peeling is preferably in a range from 20 to 200 mm/sec, and a range from 20 to 100 mm/sec is more preferred.

In the cooling process, cooling is carried out until a cooled temperature is in a range from 30 to 90° C., or preferably from 40 to 60° C., depending on thermal properties of the toners that construct the first toner layer Ta.

The cooled temperature herein means a surface temperature of a surface of the gloss processing belt 2 when the processed body Wa is peeled off. This surface of the gloss processing belt 2 is on the opposite side of the smooth surface thereof which comes in contact with the first toner layer Ta. To be more specific, the cooled temperature is a surface temperature which is measured on the surface of the gloss processing belt 2 in the cooling region Co by using an infrared radiation thermometer "IR0510" (produced by Minolta Co., Ltd.). For example, the cooled temperature is a surface temperature at a position that is 5 to 10 cm before a position where the processed body Wa is peeled off by the peeling roller 5*a*.

<Image Forming Processing for the Second Surface>

The processed body Wa, which has passed through the gloss processing device 1 and has the glossy toner image layer on the first surface of the recording material P as described above, is conveyed once to a paper discharge conveying path having a paper discharge roller 47, and then conveyed to an opposite direction. Then, the processed body Wa is diverged from the paper discharge conveying path by a branching plate 29, and inverted and conveyed by an invert mechanism (not illustrated) after passing through conveying paths 48*a* and 48*b*. Thereafter, the processed body Wa is conveyed to the secondary transfer roller 13A.

Meanwhile, in the clear toner image forming section 20HZ and the chromatic toner image forming sections 20Y, 20M, 20C, and 20Bk, toner powder layers are formed similarly to the image forming processing for the first surface, and the toner powder layers are transferred onto the second surface of the recording material P which has been transferred to the secondary transfer roller 13A.

After that, the toner powder layers transferred onto the second surface of the recording material P are fixed by heat and pressure applied thereto in the fixing device 26, thereby forming the second toner layer Tb.

Conditions of fixing processing for the second surface may be the same as the conditions of fixing processing for the first surface.

When heating time is excessively long or the nipping time is excessively long in the fixing device 26, the glossy toner image layer on the first surface is pressured while being heated by the heating pressure roller 28 in the nip area N2 during the fixing processing, and the surface shape of the heating pressure roller 28 is transferred to the glossy toner image layer, thus reducing smoothness of the glossy toner image layer. As a result, the gloss level of the glossy toner image layer of the first surface may become remarkably lower than that of the glossy toner image layer of the second surface.

<Gloss Processing for the Second Surface>

Gloss processing is carried out for the processed body Wb in the same way as the gloss processing for the first surface except for the nipping conditions. The processed body Wb is obtained by forming the second toner layer Tb on the second surface of the recording material P after the image forming processing for the second surface as described above.

A double-sided printed matter, which is obtained from the gloss processing for the second surface and has the glossy toner image layer on both sides of the recording material P, is discharged outside of the apparatus by the paper discharge roller 47 and placed on a paper discharge tray 40.

In the present invention, since the storage elastic modulus G' X (150) at 150° C. of the clear toner [X] used for the first toner layer Ta is lower than the storage elastic modulus G' Y (150) at 150° C. of the clear toner [Y] used for the second toner layer Tb. Therefore, elasticity of the first toner layer Ta is reduced by heat applied during the gloss processing for the first surface. Hence, elastic recovery is unlikely to happen when heat is applied to the first toner layer Ta due to gloss processing for the second surface. As a result, reduction in gloss level of the first toner layer Ta to which the gloss processing is conducted first is curtailed, and images are formed on the first surface and the second surface of the recording material P with a small difference in gloss level therebetween.

A preferred range of the G' X (150) is from $1\times10^2$ to $3\times10^4$ dyn/cm$^2$, and a preferred range of the G' Y (150) is from $1\times10^3$ to $1\times10^5$ dyn/cm$^2$.

By using two types of clear toners having different storage elastic moduli G' from each other, the apparatus is not complicated, and images having small difference in gloss level therebetween may be formed with ease.

Moreover, since the clear toner [Y], which is not easily deformed by heat, is used for the second surface of the recording material P, the thermal blocking is inhibited even when the image on the first surface and the image on the second surface are stacked on each other.

In the foregoing image forming apparatus 100, after the first toner layer Ta is carried on the first surface of the recording material P, the gloss processing of the first toner layer Ta is carried out. Thereafter, the second toner layer Tb is carried on the second surface of the recording material P, and finally, the gloss processing of the second toner layer Tb is conducted. However, the order of the gloss processing is not limited thereto. For example, it is possible that, after the first toner layer Ta is carried on the first surface of the recording material P, the second toner layer Tb is carried on the second surface of the recording material P, and thereafter, the gloss processing for the first toner layer Ta is carried out, and then the gloss processing for the second toner layer Tb is carried out.

The image forming apparatus 100 described above has a configuration where the gloss processing device 1 is embedded in the image forming apparatus 100. However, the gloss processing device and the image forming apparatus may be separated from each other.

The image forming apparatus 100 includes the units for exposure and development of both of the two types of clear toners (the clear toner [X] and the clear toner [Y]) and the chromatic toners. However, an image forming apparatus having units which perform exposure and development of the chromatic toners only, an image forming apparatus having units for exposure and development of the two types of the clear toners that are the clear toner [X] and the clear toner [Y] of the present invention, and the gloss processing device 1 may be provided separately from each other. Then, after the chromatic toner layers are carried on both sides of the recording material P, clear toner layers are respectively carried on the chromatic toner layers that are carried on both sides of the recording material P. Thereafter, gloss processing may be carried out for the clear toner layers on both sides of the recording material P in the gloss processing device 1.

[Toners]

Toners used in the image forming method according to the present invention are made of toner particles for electrostatic charge image development, contain a binder resin or a wax, and have a certain range of wax content in the toner particles. Examples of the toners include chromatic toners and clear toners.

<Clear Toners>

In the present invention, a clear toner is defined as a toner that does not contain any colorant such as pigment and dye. However, as long as no color is recognized due to an effect of light absorption or light scattering when a toner is formed into a fixed layer by heating and pressurizing, a toner containing a slight amount of colorant such as pigment and dye, and a toner containing colored binder resin, wax, or external additive may be included in the clear toner.

The clear toner is used for the purpose of high smoothness, in other words, high glossiness of a glossy toner image layer which is obtained by, for example, superimposing the clear toner layer on a toner image formed by chromatic toners.

<Chromatic Toners>

Chromatic toners are defined as toners that contain colorants for the purpose of coloration due to light absorption or light scattering.

<Thermoplastic Resin>

A binder resin contained in the toners used in the image forming method according to the present invention is made of a thermoplastic resin. Specific examples of the thermoplastic resin are publicly known types such as vinyl resins including a styrene resin, a (meth) acrylic resin, a styrene-acrylic resin, an olefin resin, as well as a polyester resin, a polyamide resin, a polycarbonate resin, polyether, a polyvinyl acetate resin, a polysulfone resin, and a polyurethane resin. One of these types of resins may be used independently, or two or more types of these resins may be used as a combination.

In a case where a vinyl resin and a polyester resin are combined for use, the vinyl resin and the polyester resin may be used as a mixture thereof. Alternatively, it is possible to use a resin that is made by bonding and compounding a unit of a vinyl resin, and a unit of a polyester resin with each other. By bonding these units to each other, compatibility between the vinyl resin and the polyester resin is able to be enhanced.

A method for bonding a unit of a vinyl resin and a unit of a polyester resin includes a method where a unit of a polyester resin is graft-polymerized in a vinyl resin, and a method where a unit of a vinyl resin is graft-polymerized in a polyester resin. By adopting such a method, affinity of both units is improved. Because of the high affinity, a vinyl resin and a polyester resin are not localized but compatibilized with each other, and are present evenly in toner particles. Therefore, properties of each of the resins are able to be manifested more effectively.

The thermoplastic resin may be any of a crystalline resin having a melting point, and a non-crystalline resin which has no inciting point but has a glass transition point, or a mixture thereof.

From a viewpoint of transparency of a binder resin, a styrene-acrylic resin is preferred among the above-listed thermoplastic resins. To be more specific, it is preferred that a styrene-acrylic resin is contained in a binder resin in a ratio ranging from 50 to 90% by mass. Also, it is preferred that the content of a polyester resin in the binder resin is in a range from 5 to 50% by mass, and more preferably, 10 to 30% by mass.

It is most preferred that the thermoplastic resin itself which is contained in the binder resin is transparent. However, a resin having a light yellowish color, such as a polyester resin, is able to be used as the thermoplastic resin without affecting transparency of the glossy toner image layer obtained.

A resin used as the styrene-acrylic resin may be obtained by polymerizing styrene monomer and (meth)acrylic acid or (meth)acrylic acid ester monomer in a publicly-known method such as radical polymerization reaction.

Examples of the styrene monomer include styrene, o-methylstyrene, m-methylstyrene, p-methylstyrene, α-methylstyrene, p-chlorostyrene, 3,4-dichlorostyrene, p-n-butylstyrene, p-tert-butylstyrene, p-nonylstyrene, and p-phenylstyrene. Examples of the (meth)acrylic acid include acrylic acid, methacrylic acid, itaconic acid, fumaric acid, and maleic acid. Examples of the (meth)acrylic acid ester monomer include methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate, as well as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate. One of those listed above may be used independently, or two or more types thereof may be used as a combination. Of those monomers listed above, styrene, butyl acrylate, 2-ethylhexyl acrylate, ethyl methacrylate, methacrylate, and acrylate are preferred.

Together with the styrene monomer and the (meth)acrylic acid or the (meth)acrylic acid ester monomer, an another polymerizable monomer may be polymerized. Examples of another polymerizable monomer include polyfunctionalized vinyl such as vinyl benzene, ethylene glycol dimethacrylate, ethylene glycol diacrylate, diethylene glycol dimethacrylate, diethylene glycol diacrylate, triethylene glycol dimethacrylate, triethlene glycol diacrylate, neopentyl glycol dimethacrylate, and neopentyl glycol diacrylate. By using a polyfunctionalized vinyl, a styrene-acrylic rein having a bridged structure is able to be obtained.

<Wax>

Examples of the wax contained in the toners include polyolefin wax such as polyethylene wax and polypropylene wax, branched chain hydrocarbon wax such as micro crystalline wax, long chain hydrocarbon-based wax such as paraffin wax and Sasolwax, dialkylketone-based wax such as distearyl ketone, ester wax such as carnauba wax, montan wax, behenate, trimethylolpropane tri behenate, pentaerythritol tetrabehenate, pentaerythritol diacetate dibehenate, glyceryl tribehenate, 1,18-octadecanediol distearate, tristearyl trimellitate, and distearyl maleate, and amide wax such as ethylene diamine behenylamide, and tristearylamide trimellitate.

Of the waxes listed, above, those having low crystallinity are preferred, because there is no anisotropic aspect during crystallization in which the waxes are solidified from a melting state, and transparency within the glossy toner image layer is thus improved. It is thus preferred to use, for example, paraffin wax, oxidized polyethylene wax, polypropylene wax, oxidized polypropylene wax, carnauba wax, Sasolwax, rice wax, candellila wax, johoba oil wax, and beeswax.

A melting point of the wax contained in the toners is indicated by a melting peak temperature which is obtained from an endothermic peak of the wax that is obtained by DSC measurement of the toners. For the toners according to the present invention, a preferable melting peak temperature ranges from 55 to 90° C. from the viewpoint of fixation and separation ability and heat-resistant preservability of the toners.

The content of the wax in toner particles is expressed by melting energy ΔH which is found by a melting peak area that is obtained from the endothermic peak of the wax obtained by the DSC measurement. For the toners according to the present invention, the value of ΔH ranges from 0.2 to 3014 J/g, and it is preferred that ΔH ranges from 0.4 to 13 J/g.

By having the content of the wax in the toner particles within the above-mentioned range, it is possible to enhance transparency and improve quality of the glossy toner image layers of a double-sided printed matter, because light scattering is inhibited in an interface between an area containing the wax and an area containing the binder resin within each of the glossy toner image layers. In addition, thermal energy required for realizing a desired gloss level of the glossy toner image layers is able to be reduced.

Moreover, because ΔH, the content of the wax in the toner particles, is 3014 J/g or lower, it is possible that, in the glossy toner image layer that is formed on the first surface of the recording material P, reduction in smoothness of the glossy toner image layer due to melting and recrystallization of the wax contained therein during the gloss processing for the second surface is curtailed. Therefore, such an effect is produced that reduces a difference in gloss level between the glossy toner image layers on both sides of the recording material P.

When the content of the wax in the toner particles is excessively small, separation from the heating pressure rollers 27 and 28 of the fixing device 26 may be difficult. When the content of the wax in the toner particles is too large, smoothness of the glossy toner image layer formed on the first surface of the recording material P is significantly reduced by melting and recrystallization of the wax contained therein during the gloss processing for the second surface. This may make it impossible to form the glossy toner image layer having desired smoothness on the first surface of the recording material P.

When the wax is in a droplet state or has so-called sea island structure within the binder resin, transparency of the glossy toner image layer obtained is reduced, and dullness is strongly recognized. Therefore, reduction of the content of the wax is preferred.

The DSC measurement of the toners is carried out by using "Diamond DSC" (produced by PerkinElmer Co., Ltd.) in the following way.

Specifically, a measurement procedure is that 3.0 mg of a toner is filled in an aluminum pan, and set to a holder. An empty aluminum pan is used for reference. Measurement conditions are a measurement temperature ranging from 0 to 200° C., a rate of temperature increase of 10° C./minute, a rate of temperature decrease of 10° C./minute, and a temperature control of heating, cooling, and heating.

Melting energy ΔH (Jig) is a value obtained by calculating a heat quantity per unit mass from an endothermic peak that is derived from the wax in the second heating.

<Colorant>

When the toner is a chromatic toner, a generally-known dye or pigment may be used as a colorant contained in the toner.

For a colorant for obtaining a black toner, publicly-known various colorants may be used, including carbon black such as furnace black and channel black, a magnetic body such as magnetite and ferrite, and an inorganic pigment containing dye and non-magnetic oxide of iron.

Specific examples of colorants for obtaining color toners include pigments such as C.I. Pigment Red 5, 48:1, 53:1, 57:1, 81:4, 122, 139, 144, 149, 166, 177, 178, 222, 238, and 269, C.I. Pigment Yellow 14, 17, 74, 93, 94, 138, 155, 180, and 183, C.I. Pigment Orange 13, 31, and 43, Pigment Blue 15:3, 60, and 76, as well as dyes such as C.I Solvent Red 1, 49, 52, 58, 68, 11, and 122, C.I. Solvent Yellow 19, 44, 77, 79, 81, 82, 93, 98, 103, 104, 112, and 162, and C.I. Solvent Blue 25, 36, 69, 70, 93, and 95.

In order to obtain each color, one type of the colorants or a combination of two or more types of the colorants may be used.

A number average primary particle size of the colorant in the toner particles is different depending on the type of the colorant, but preferably within a range from approximately 10 to 200 nm.

A preferred content of the colorant in the toner is within a range from 1 to 10% by mass, and a range from 2 to 8% by mass is more preferred. When the content of the colorant in the toner is less than 1% by mass, the toner obtained may not have sufficient coloring power. On the other hand, when the content of the colorant in the toner is over 10% by mass, liberation of the colorant or attachment of the colorant to a carrier may happen, thereby affecting chargeability.

A preferred softening point of the toner ranges from 80 to 140° C. from the viewpoint of fixability of the toner, and a range from 90 to 120° C. is more preferred.

The softening point of the toner is measured by a flow tester described below.

To be specific, 1.1 g of a toner is first put and flattened out in a petri dish and left for 12 hours or longer in an environment of 20° C. and 50% RH. Thereafter, the toner is pressured for 30 seconds with a power of 3820 kg/cm$^2$ by a molding machine "SSP-10A" (produced by Shimazu Corporation) to make a columnar molded sample having a diameter of 1 cm. Next, in an environment of 24° C. and 50% RH, the molded sample is extruded from a columnar-shaped die hole (1 mm diameter×1 mm) using a piston having a diameter of 1 cm from the end of pre-heat time by using a flow tester "OFT-500D" (produced by Shimazu Corporation) under the conditions of a load of 196 N (20 kgf), an initiation temperature of 60° C., pre-heat time of 300 seconds, and a rate of temperature increase of 6° C./minutes. Then, an offset method temperature $T_{offset}$ is measured with an offset value set to 5 mm in a melting temperature measuring method of a temperature rising method, and this offset method temperature $T_{offset}$ is used as a softening point of the toner.

As an entire molecular weight of the binder resin contained in the toner, a number average molecular weight (Mn) ranges preferably from 3,000 to 6,000, and more preferably 3,500 to 5,500, and a ratio between a weight average molecular weight (Mw) and the number average molecular weight (Mn), which is Mw/Mn, ranges preferably from 2.0 to 6.0, and more preferably from 2.5 to 5.5.

The molecular weight of the binder resin contained in the toner is obtained by measuring the toner as a measurement sample by using a gel permeation chromatography (GPC) of a tetrahydrofuran (THF) soluble element. The specific measurement method is as follows.

By using a device "HLC-8220" (produced by Tosoh Corporation) and a column TSK guard column+TSK gel Super HZM-M3 (produced by Tosoh Corporation), tetrahydrofuran (THF) is flown as a carrier solvent at a flow velocity of 0.2 ml/min while maintaining a column temperature at 40° C. Then, the measurement sample (toner) is processed by an ultrasonic dispenser for 5 minutes in an ambient temperature, such that the measurement sample (toner) is dissolved in tetrahydrofuran with a concentration of 1 mg/ml, and then processed by a membrane filter having a pore size of 0.2 μm, thus obtaining a sample solution. 10 μL of this sample solution is injected into the device together with the above-mentioned carrier solvent, and detected by using a refractive index detector (RI detector). A molecular weight distribution of the measurement sample is calculated using a standard curve which is measured by using monodispersed polystyrene standard particles. As examples of a standard polystyrene sample, those having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, produced by Pressure Chemical Company, are used. At least about 10 standard polystyrene samples are measured, and a standard curve is made. A refractive index detector is used as the detector.

<Average Particle Size of Toners>

The preferred average particle size of the foregoing toners is within a range of volume-based median diameter from 3 to 10 μm, and a range from 6 to 9 μm is further preferred. The average particle size of the toners is able to be controlled based on a concentration of an aggregating agent (salting-out agent) to be used, timing to add an anti-aggregation agent, a temperature during aggregation, and a polymer composition. Since the volume-based median diameter is within the above-mentioned range, transfer efficiency is improved, thereby enhancing halftone image quality and image qualities of thin lines, dots, and so on.

The volume-based, median diameter of the toners is measured and calculated by using an apparatus in which a computer system for data processing (produced by Beckman Coulter, Inc.) is connected to "Coulter Counter Multisizer 3" (produced by Beckman Coulter, Inc.).

To be more specific, after 0.02 g of a toner is added and mixed in 20 mL of a surface acting agent solution (a surface acting agent solution in which, for example, a neutral detergent containing a surface acting agent is 100-fold diluted with pure water, for the purpose of dispersion of the toner), ultrasonic dispersion is conducted for one minute, and a toner dispersion liquid is prepared. The toner dispersion liquid is injected with a pipette into a beaker which contains an electrolytic solution "ISOTONII" (produced by Beckman Coulter, Inc.) inside a sample stand, until a concentration displayed on a measurement device reaches a range from 5 to 10%. With such a range of the concentration, a reproducible measurement value is obtained. In the measurement device, a number of counts of particles for measurement is set to 25,000, and an aperture diameter is set to 100 μm, and then a frequency value is calculated after dividing a range of measurement from 2 to 60 μm into 256. Then, a particle size at 50% from the largest volume-based cumulative fraction (diameter of volume D50%) is defined as a volume-based median diameter.

<Average Circularity>

In a viewpoint of transfer efficiency, it is preferred that individual toner particles contained in these toners described so far have an average circularity ranging from 0.850 to 1.000, and more preferably, from 0.900 to 0.995.

As the average circularity is within the range from 0.850 to 1.000, filling density of toner particles in the toner layers transferred on the recording material P is increased, and fixing offset is thus less likely to happen. Moreover, individual toner particles are less likely to be broken up, thereby reducing contamination of a triboelectric charging member, and stabilizing chargeability of the toners.

The average circularity of the toners is a value obtained from measurement using a "FPIA-2100" (produced by Sysmex Corporation). Specifically, a toner is mixed in an aqueous solution containing a surface acting agent, and then dispersed by conducting ultrasonic dispersion processing for one minute. Thereafter, dispersion of the toner particles photographed with "FPIA-2100" (produced by Sysmex Corporation) in a HPF (high-magnification photographing) mode at an appropriate density of the HPF detection number of 3,000 to 10,000 as a measurement condition. The circularity of each toner particle is then calculated in accordance with an equation (T) stated below. Then, the average circularity is calculated by summing circularity of each of the toner particles and dividing the resulting value by the total number of the toner particles. Reproducibility is realized with the above range of HPF detection number.

Circularity=(a circumferential length of a circle having the same projected area as a particle image)/(a circumferential length of a particle projected image) Equation (T)

<Toner Manufacturing Method>

Examples of a method for fabricating the toners according to the present invention include a kneading and grinding method, a suspension polymerization method, an emulsion aggregation method, a dissolution suspension method, a polyester extension method, and a dispersion polymerization method.

Of those listed above, it is preferred to adopt the emulsion aggregation method from viewpoints of uniformity of particle sizes, shape controllability, and formability of core-shell structure, which are favorable for high quality and stability of images.

In the emulsion aggregation method, a resin fine particle dispersion liquid, in which resin fine particles are dispersed by a surface acting agent or a dispersion stabilizer, is mixed with a dispersion liquid of constituents of toner particles such as colorant fine particles where necessary, and then an aggregating agent is added thereto to aggregate the resultant solution until a desired toner particle size is obtained. Thereafter, or simultaneously with the aggregation, the resin fine particles are fused to one another, and shape control is conducted. Thus, toner particles are manufactured.

Here, the resin fine particles may arbitrarily contain an internal additive such as a release agent and a charge-controlling agent. Alternatively, the resin fine particles may be composite particles formed by a plurality layers having two or more layers of resins having different composites from each other.

From a viewpoint of structure design of the toners, it is preferred that different types of resin fine particles are added during the aggregation so as to obtain toner particles having a core-shell structure.

The resin fine particles may be fabricated by, for example, an emulsion polymerization method, a miniemulsion polymerization method, and a phase transition emulsification method, or a combination of several methods. In a case where an internal additive is contained in the resin fine particles, the miniemulsion polymerization method is particularly preferred.

<External Additive>

The toner particles described above are able to construct the toners according to the present invention on their own.

However, in order to improve fluidity, chargeability, and cleanability, the toners according to the present invention may be constructed by adding an external additive to the toner particles. Examples of the external additive include fluidizer and cleaning auxiliary agent, which serve as a so-called after treatment agent.

Examples of the after treatment agent include inorganic oxide microparticles made from silica microparticles, alumina microparticulate, or titanium oxide microparticles, inorganic stearic acid compound microparticles such as aluminum stearate microparticles and zinc stearate microparticles, or inorganic titanic acid compound microparticles such as strontium titanate and zinc titanate. One type of the after treatment agents above may be used independently or a combination of two or more types thereof may be used.

Preferably, these inorganic microparticles are gloss-processed by a silane coupling agent, a titanium coupling agent, higher fatty acid, silicone oil, or the like, in order to improve heat-resistant preservability and environmental stability.

A total amount of these various external additives is in a range from 0.05 to 5 parts by mass, or, preferably, from 0.1 to 3 parts by mass, relative to 100 parts by mass of the toner. A combination of various types of additives may be used as the external additive.

<Developer>

The above-described toner may be used as a magnetic or non-magnetic single component developer, but may also be mixed with a carrier and used as a two-component developer. In a case where the toner is used as a two-component developer, a carrier may be magnetic particles made of a conventionally and publicly known material which includes metal such as iron, ferrite, and magnetite, and an alloy of the metal listed above and metal such as aluminum and lead. Ferrite is particularly preferred. Further, as the carrier, it is possible to use a coat carrier in which surfaces of magnetic particles are covered with a covering agent such as a resin, or a binder-type carrier in which magnetic material fine powder is dispersed in a binder resin.

Examples of the covering resin contained in the coat carrier include, but not particularly limited to, an olefin resin, a styrene resin, a styrene acrylic resin, a silicon resin, an ester resin, and a fluorine resin. A resin which constructs a resin dispersion type carrier is not particularly and a publicly-known resin such as a styrene acrylic resin, a polyester resin, a fluorine resin, and a phenol resin may be used.

Preferably, a volume-based median diameter of the carrier is within a range from 20 to 100 μm, and a range from 20 to 60 μm is more preferred. The volume-based median diameter of the carrier is able to be typically measured by a laser diffraction particle size distribution analyzer "HELOS" (produced by Sympatec GmbH) having a wet disperser.

<Recording Material>

The recording material P used for the image forming method according to the present invention only needs to be able to hold the glossy toner image layer. Specific examples of the recording material P include, but not limited to, plain paper from thin paper to heavy paper, coated printing paper such as high-quality paper, art paper, and coated paper, and various other commercially-available printing paper such as Japanese paper and postcard paper.

EXAMPLES

1. Fabrication of a Clear Toner [X-1]

(1) Fabrication of Resin Fine Particles [X-1]

(First-stage Polymerization)

4 parts by mass of polyoxyethylene 2-dodecyl ether sodium sulfate and 3000 parts by mass of ion-exchanged water were put in a reaction container to which an agitator, a temperature sensor, a cooling pipe, and a nitrogen introduction device were attached. A temperature of a resultant solution was increased to 80° C. while agitating the solution at an agitating rate of 230 rpm in a nitrogen gas flow.

After the temperature was increased, an initiator solution, which is obtained, by dissolving 4 parts by mass of potassium persulfate (KPS) in 200 parts by mass of ion-exchanged water, was added to the solution, and a liquid temperature was adjusted to 75° C. Then, 567 parts by mass of styrene, 165 parts by mass of n-butyl acrylate, and 68 parts by mass of methacrylic acid were dropped in an hour. After the dropping, the solution is heated and agitated at 75° C. for two hours to cause polymerization reaction. Thus, a resin fine particle dispersion liquid having dispersed resin fine particles [X-1] was prepared. A weight average molecular weight of the resin fine particles [X-1] was measured, and was 300,000.

(2) Fabrication of Resin Fine Particles [X-2]

(Second-stage Polymerization)

Next, 2 parts by mass of polyoxyethylene 2-dodecyl ether sodium sulfate and 1270 parts by mass of ion-exchanged water were put in a reaction container to which an agitator, a temperature sensor, a cooling pipe, and a nitrogen introduction device were attached, and the resultant solution was heated to 80° C. After the heating, 40 parts by mass of the above-mentioned resin fine particle dispersion liquid [X-1] in terms of a solid content, and a monomer mixed liquid, in which 129 parts by mass of styrene, 47 parts by mass of n-butyl acrylate 15 parts by mass of methacrylic acid 0.5 parts by mass of n-octyl mercaptan, and 80 parts by mass of "HNP-57" (produced by Nippon Seiro Co., Ltd)

were warmed to 80° C. to dissolve "NHP-57", were added to the solution, and then blended and dispersed for an hour with a mechanical dispersion device "CLEARMIX" (produced by M Technique Co.; Ltd.) haying a circular pathway. Thus, an emulsion particle dispersion liquid was prepared. To this emulsion particle dispersion liquid, an initiator solution is added. The initiator solution was made by dissolving 6 parts by mass of potassium persulfate (KPS) in 100 parts by mass of ion-exchanged water. Then a resultant solution is heated and agitated for an hour at 80° C. to cause polymerization reaction. As a result, a resin fine particle dispersion liquid [X-2] made by dispersed resin fine particles [X-2] was prepared. A high molecular weight component ratio of the resin fine particles [X-2] was 52 area %.

(3) Fabrication of Resin Fine Particles [X-3]

(Third-stage Polymerization)

Next, an initiator solution was added to the resin fine particle dispersion liquid [X-2]. The initiator solution was made by dissolving 10 parts by mass of potassium persulfate (KPS) in 200 parts by mass of ion-exchanged water. Thereafter, a liquid temperature of a resultant solution is increased to 80° C. Then, 417 parts by mass of styrene, 131 parts by mass of n-butyl acrylate 23 parts by mass of methacrylic acid, and 13 parts by mass of n-octyl mercaptan, were dropped in an hour. After the dropping, the solution was heated and agitated at 80° C. for two hours to cause polymerization reaction. Then, the solution is cooled to 28° C. Thus, a resin fine particle dispersion liquid [X-3] made of dispersed resin fine particles [X-3] was prepared (4) Fabrication of a Clear Toner [X-1]

450 parts by mass of the resin fine particle dispersion liquid [X-3] (in terms of solid content), 1100 parts by mass of ion-exchanged water, and 2 parts by mass of dodecyl sodium sulfate were put and agitated in a reaction container to which an agitator, a temperature sensor, a cooling pipe, and a nitrogen introduction device were attached. After adjusting an inside temperature of the reaction container to 30° C., 5 mol/L of aqueous sodium hydroxide was added to a resultant solution so that pH was adjusted to 10.

Next, 10 minutes were spent to add an aqueous solution to the solution at 30° C. under agitation. The aqueous solution was made by dissolving 70 parts by mass of magnesium chloride hexahydrate in 75 parts by mass of ion-exchanged water. After a resultant solution was left for three minutes, temperature of this system was increased to 85° C. in 60 minutes, and aggregation and fusion of the resin fine particles [X-3] were continued while maintaining the temperature at 85° C. In this state, particle sizes of aggregated particles formed were measured with "Multisizer 3" (produced by Beckman Coulter, Inc.). When a volume-based median diameter of an aggregated particle became 6.7 μm, an aqueous solution, which was made by dissolving 200 parts by mass of sodium chloride in 860 parts by mass of ion-exchanged water, was added to stop aggregation.

After stopping the aggregation, heating agitation of the solution was conducted as maturing processing for 8 hours at a liquid temperature of 98° C. so as to facilitate fusion between fine particles of the aggregated particles. Thus, toner base particles [X-1] were obtained. After the maturing processing, the liquid temperature was reduced to 30° C., hydrochloric acid was used to adjust pH in the liquid to 2, and agitation was stopped.

The solid-liquid separation of the obtained toner base particles [X-1] was carried out by using a basket centrifuge "MARK III model number 60×40" (produced by Matsumoto Machine Group Co., Ltd.), and wet cake of the toner base particles [X-1] was formed. After the wet cake was washed with ion-exchanged water at 40° C. in the basket centrifuge until electrical conductivity of a filterate became 5 μS/cm, the wet cake was moved to "Flash Jet Dryer" (produced by Seisin Enterprise Co., Ltd.) and dried until an amount of water became 0.5 mass %. Thus, the toner base particles [X-1] were obtained.

To the toner base particles [X-1] an external additive was added. The external additive was made of 1.0 parts by mass of silica treated with hexamethylsilazane (with average primary particle size of 12 nm, and hydrophobicity of 68), and 0.3 parts by mass of titanium dioxide treated with n-octylsilane (with average primary particle size of 20 nm, hydrophobicity of 63). Then, external addition treatment was conduced by using Henschel mixer (produced by Mitsui Miike Co., Ltd.). Thus, a clear toner [X-1] was obtained.

Conditions for the external addition treatment by the Henschel mixer were a peripheral speed of an agitation blade of 35 m/sec, a treatment temperature of 35° C., and treatment time of 15 minutes.

2. Fabrication of a Clear Toner [X-2]

A clear toner [X-2] was fabricated in the same way as the fabrication example of the clear toner [X-1] except that a monomer mixed liquid having a formula stated below was used in the third-stage polymerization process:

423 parts by mass of styrene,
143 parts by mass of n-butyl acrylate,
6 parts by mass of methacrylic acid, and
13 parts by mass of n-octyl mercaptan.

3. Fabrication of a Clear Toner [X-3]

A clear toner [X-3] was fabricated in the same way as the fabrication example of the clear toner [X-1] except that a monomer mixed liquid having a formula stated below was used in the third-stage polymerization process:

386 parts by mass of styrene,
134 parts by mass of n-butyl acrylate,
51 parts by mass of methacrylic acid, and
13 parts by mass of n-octyl mercaptan.

4. Fabrication of a Clear Toner [Y-1

A clear toner [Y-1] was fabricated in the same way as the fabrication example of the clear toner [X-1] except that a monomer mixed liquid having a formula stated below was used in the third-stage polymerization process:

385 parts by mass of styrene,
128 parts by mass of n-butyl acrylate
57 parts by mass of methacrylic acid, and
11 parts by mass of n-octyl mercaptan.

5. Fabrication of a Clear Toner [Y-2]

A clear toner [Y-2] was fabricated in the same way as the fabrication example of the clear toner [X-1] except that a monomer mixed liquid having a formula stated below was used in the third-stage polymerization process:

388 parts by mass of styrene,
114 parts by mass of n-butyl acrylate,
69 parts by mass of methacrylic acid, and
7 parts by mass of n-octyl mercaptan.

6. Fabrication of a Clear Toner [Y-3]

A clear toner [Y-3] was fabricated in the same way as the fabrication example of the clear toner [X-1] except that a monomer mixed liquid having a formula stated below was used in the third-stage polymerization process:

417 parts by mass of styrene,
69 parts by mass of n-butyl acrylate,
86 parts by mass of methacrylic acid, and
13 parts by mass of n-octyl mercaptan.

7. Preparation of a Developer

A ferrite carrier coated with a silicon resin and having a volume-based median diameter of 60 μm was blended with the fabricated clear toner [X-1] by using a V-type blender, so that a concentration of the clear toner [X-1] became 6 mass %. Thus, a clear toner developer [X-1] was prepared.

Further, in the same way as the clear toner developer [X-1], clear toners [X-2], [X-3], and [Y-1] to [Y-3] were prepared using the fabricated clear toners [X-2], [X-3], and [Y-1] to [Y-3], respectively.

8. Evaluation

With a digital copier "bizhub C 353" (produced by Konica Minolta Business Technologies, Inc.), test image-printed matters were formed. In the test image-printed matters, full-color images were fixed on both sides of a recording material "OK topcoat +" (with basis weight of 157 g/m$^2$, and paper thickness of 131 μm) (produced by Oji Paper Co., Ltd.).

By using the image forming apparatus shown in FIG. 1, clear toner layers were formed on the entire first surfaces of the test image-printed matters, respectively, using the developers [X-1] to [X-3] and [Y-1] to [Y-3], respectively, in an environment at normal temperature and humidity (humidity of 20° C., and a relative humidity of 50% RH) and with a toner adhesion of 4 g/m$^2$. Then, the test image-printed matters with the clear toner layers formed on the first surfaces thereof were treated as processed bodies, and the first surfaces thereof were gloss-processed with the gloss processing device shown in FIG. 3. Thereafter, clear toner layers were formed on the entire second surfaces in the same way as above. Then the test image-printed matters with the clear toner layers formed on the second surfaces thereof were treated as processed bodies, and the second surfaces thereof were gloss-processed in the same way as above. Thus, double-sided printed matters [P-1] to [P-8] were obtained.

Conditions for the gloss processing are described below.

—Configuration Conditions—

(a) Material of the gloss processing belt: A polyimide film (thickness of 50 μm) having a surface layer (thickness of 10 μm) that contains fluorine resin and polysiloxane. Hardness thereof is 1.5 CPa and a contact angle thereof is 95°.

(b) Surface roughness of the gloss processing belt: Initial surface roughness Ra=0.4 μm.

(c) Heat roller: An aluminum base body having an outer diameter of 100 mm and a thickness of 10 mm with a halogen lamp (source of heat) provided inside of the aluminum base body. Temperature of the halogen lamp is controlled by a thermistor.

(d) Pressure roller: An aluminum base body having an outer diameter of 800 mm and a thickness of 10 mm, and covered by a 3 mm-thick silicon rubber layer.

(e) Length of the nip area in a conveying direction: 11 mm (f) Distance between the nip area and the peeling roller: 620 mm —Control Conditions—

(g) Heating temperature: Controlled to be 155° C. in principle (h) Pressure: 0.29 MPa (i) Cooling temperature: Controlled to be 50° C. in principle (in Example 4, controlled to be 35° C.)

(j) Speed of conveying the processed body: 220/sec (k) Conveying direction of the processed body: Portrait direction (1) Physical Properties A storage elastic modulus G' of each of the fabricated clear toners [X-1] to [X-3] and [Y-1] to [Y-3] was measured in the aforementioned method. Results of the measurements are shown in Table 1 below. In Table 1, the storage elastic modulus of the first surface is expressed as G' (150) dyn/cm$^2$, the storage elastic modulus of the second surface is expressed as G' Y (150) dyn/cm$^2$, and a difference between the storage elastic moduli on the first surface and the second surface is expressed as Δ[G' Y (150)−G' X (150)] dyn/cm$^2$.

(2) Gloss at 20°

With respect to each of the fabricated double-sided printed matters [P-1] to [P-8], gloss levels of gloss surfaces formed on the first surface (front side) and the second surface (back side) were measured, respectively, by using a gloss meter "GMX-203" (produced by Murakami Color Research Laboratory Co., Ltd.), and evaluated. A measurement angle was set to 20°, and the measurements were carried out based on "JIS Z8741 1983 method 2". The gloss level was defined as an average value of the gloss levels at 5 spots, which are the center and four corners in each of the printed matters. The results are shown in Table 1. In Table 1, the gloss level of the first surface is expressed as K [X], the gloss level of the second surface is expressed as K [Y], and a difference in gloss level between the second surface and the first surface is expressed as Δ (K [Y]−K [X]). An acceptable level of Δ (K [Y]−K [X]) under 15, with which difference in gloss level is not recognized.

(3) Blocking

A finisher FS-608 (produced by Konica Minolta Business Technologies, Inc.) was mounted on a digital copier "bizhub C 353" (produced by Konica Minolta Business Technologies, Inc.), and an automatic binding test of 20 copies of saddle-stitched printed matters (5 pages per copy) was repeated for 50 times. A pixel ratio per page was set to 50%. Transfer paper having a basis weight of 64 g was used for evaluation. After the printed matters were naturally cooled to an ambient temperature, all pages were flipped with one hand, and it was checked whether there were images sticking together. ◎ and ○ mean that they are at an acceptable revel.

◎: No images were stuck together, and there was no feeling of strangeness when flipping pages.

○: There was a slight feel of friction when flipping the stacked pages, but no images were stuck together.

x: Images were stuck together when flipping the stacked pages.

From the results shown in Table 1 illustrated in FIG. 5, it is understood that, compared to the printed matters [P6], [P7] and [P8], the printed matters [P1] to [P5] have higher gloss levels, smaller differences in gloss levels between both sides, and are less likely to have thermal blocking, Although various typical embodiments have been stated and explained so far, the present invention is not limited to these embodiments. Therefore, the scope of the present invention is limited only by the scope of patent claims set forth below.

What is claimed is:

1. An image forming method, comprising:

performing a first gloss processing including:

heating and pressing a processed body which supports a first toner layer containing at least a clear toner [X] onto a first surface of a recording material, while allowing the first toner layer to be closely adhered to a gloss processing belt; and cooling the heated and pressed processed body, whereby glossiness is added to a surface of the first toner layer, and performing a second gloss processing including:

heating and pressing a processed body which supports a second toner layer containing at least a clear toner [Y] onto a second surface of the recording material, while allowing the second toner layer to be closely adhered to the gloss processing belt; and cooling the heated and pressed processed body, whereby glossiness is added to a surface of the second toner layer, wherein a storage elastic modulus G' X (150) at 150° C. of the clear toner [X] used for the first toner layer is lower than a storage elastic modulus G' Y (150) at 150° C. of the clear toner [Y] used for the second toner layer.

2. The image forming method according to claim 1, wherein, the clear toner [X] and the clear toner [Y] are in a relationship expressed by an equation below, where a difference between the storage elastic modulus G' X (150) at 150° C. of the clear toner [X] and the storage elastic modulus G' Y (150) at 150° C. of the clear toner [Y] is expressed as Δ[G' Y (150)−G' X (150)];

$$\Delta[G'Y(150)-G'X(150)]>5\times10^3\ \text{dyn/cm}^2.$$

3. The image forming method according to claim 1, wherein the G' X (150) is within a range from $1\times10^2$ to $3\times10^4$ dyn/cm$^2$.

4. The image forming method according to claim 1, wherein G' Y (150) is within a range from $1\times10^3$ to $1\times10^5$ dyn/cm$^2$.

* * * * *